United States Patent [19]

Smith-Johannsen

[11] Patent Number: 4,540,195

[45] Date of Patent: Sep. 10, 1985

[54] CROSS-COUNTRY SKI SOLE

[75] Inventor: Robert Smith-Johannsen, Incline Village, Nev.

[73] Assignee: Ramu International, Incline Village, Nev.

[21] Appl. No.: 469,048

[22] Filed: Feb. 23, 1983

[51] Int. Cl.[3] ..... A63C 5/04; A63C 5/12

[52] U.S. Cl. ..... 280/610; 156/244.12; 156/224; 156/276; 264/210.2; 264/216; 428/87; 428/212; 428/217

[58] Field of Search ..... 280/610; 428/212, 217, 428/87; 156/244.12, 246, 276; 264/210.2, 216

[56] References Cited

U.S. PATENT DOCUMENTS

| | | | |
|---|---|---|---|
| 3,897,074 | 7/1975 | Tiitola | 280/610 |
| 4,272,577 | 6/1981 | Lyng | 280/610 |

FOREIGN PATENT DOCUMENTS

| | | | |
|---|---|---|---|
| 317734 | 12/1973 | Austria . | |
| 1120965 | 3/1982 | Canada | 280/610 |
| 1301747 | 8/1969 | Fed. Rep. of Germany | 280/610 |

*Primary Examiner*—James C. Cannon
*Attorney, Agent, or Firm*—Pennie & Edmonds

[57] ABSTRACT

A composite useful as a ski sole comprising polyethylene particles in a polyethylene film, the former having a greater hardness or higher melt index than the latter, which is capable of renewably forming fibrils extending from a surface thereof under the abrasion characteristic of skiing conditions. The particles may have been treated with a material which is incompatible with or reduces the adhesion to the film-forming polyethylene.

12 Claims, No Drawings

CROSS-COUNTRY SKI SOLE

TECHNICAL FIELD

The field of the invention is cross-country skis.

BACKGROUND OF THE INVENTION

A cross-country skier depends on a difference in static and dynamic friction on the snow to enable him to "kick and slide". When skis were made of wood, there was a reasonable ratio between static and dynamic friction on dry snow. However, when a water lubrication layer was present on the snow (damp or wet snow), the static friction was greatly reduced, making it difficult to progress by a simple "kick and slide". Ski waxes were developed to overcome this problem. By adjusting the consistency of the wax to that of the snow, it was possible to provide an enhanced grip on the snow particles while the ski was at rest, without unduly compromising the sliding friction.

With the more recent advent of plastic ski soles, with their inherent improved sliding ability, the static friction was lowered so much that waxing became essential under all snow conditions. But waxing correctly is somewhat of an art, and it is obvious that there is a need for a ski sole which will provide a satisfactory "kick and slide" function, independent of widely differing snow conditions. Accordingly there has been a serious demand for such a ski sole, and various attempts have been made to satisfy it.

The grip on the snow depends on two factors, a mechanical accommodation to the snow surface and a surface chemical adhesion. The mechanical technique has been greatly refined and consists of providing a directionally shaped surface on the ski sole in the form of backward facing steps or "fish scales" which engage the snow when the ski tends to slide backward. The deeper the steps and the more of them the better the grip but the poorer the glide.

The chemical adhesion technique has also been tried and consists of providing hydrophilic sites on the ski sole surface, (U.S. Pat. No. 3,897,074). These hydrophilic sites act through a film of water, and in that way provide climbing ability, but on dry snow some mechanical effect is also necessary.

Another method that has been tried combines both mechanical and chemical effects. The so-called mica ski sole contains many relatively large mica flakes embedded in the plastic matrix and oriented so as to provide, when abraded, a stepped surface on a micro scale. The use of mica results in the surface being hydrophilic. Such skis climb well on wet snow but glides very poorly on all but a few kinds of snow. The mica ski is disclosed in Norwegian Patent Application No. 772,044.

All of these patterned surfaces attempt to create a surface which has a low coefficient of friction in the gliding direction, with a higher coefficient in the reverse direction; hence, the idea of oriented steps, or "fish scales" or mica structures. However, all of these surfaces suffer from the same compromise between climbing and gliding properties.

A no wax ski will not be satisfactory unless it can perform on most snow conditions as well as a well-waxed ski, something that until now has been considered virtually impossible.

DISCLOSURE OF THE INVENTION

The subject invention seeks to simulate the low dynamic coefficient of friction on wet or dry snow that is exhibited by well-waxed skis, while exhibiting a very high static friction. In this concept, coefficient of friction in the reverse direction is of little concern.

By means of this invention a mechanical grip is established on a micro scale, so fine that it does not appreciably interfere with the glide, and yet sufficient to climb on all snow conditions. The physical surface structure which is continually renewed by normal wear by skiing consists entirely of highly hydrophobic materials, something that is essential for the good performance of a ski sole.

The ski sole of this invention is a multi-phase structure comprising a polyethylene film having embedded therein a plurality of particles of polyethylene of a greater hardness or melt index than the film-forming polyethylene and which are weakly bonded in the film phase. The difference in melt index or hardness between the particles and the film-forming polyethylene is sufficient to create frictional discontinuities between the film and the particles so that upon abrasion of the surfaces of the multi-phase structure a plurality of microfibrils are formed at the surface of the structure. Although these microfibrils wear off during skiing, the normal wear encountered when skiing continuously regenerates the microfibrils.

The method of making the multi-phase polyethylene structures of this invention which are particularly useful as ski soles involves first the treating of at least a portion of the surfaces of polyethylene particles used to form the particle phase with a hydrophobic material which is incompatible with polyethylene, or one which will reduce the strength of the adhesion of the polyethylene particles to the polyethylene film under normal extrusion conditions. These treated particles are then incorporated into a polyethylene of lower melt index or hardness which forms the film phase. The difference in melt indices or hardness is sufficient so that when the two types of polyethylene are intermixed and extruded, the polyethylene of lower melt index or hardness will form a film in the normal manner while the particles used to form the particle phase will remain as particles. Due to the treatment of the particles before mixing, the adhesion of the particles to the film-forming polyethylene phase will be less than that which would normally have occurred absent such treatment, and actually a very small third phase exists between the film and particle phases. This treatment of the particles also aids in maintaining the integrity of both the particles and film and, renders the phases partly incompatible so that microfibrils are developed at the discontinuities or the interfaces between the particle and film when the structure is abraded so that the microfibrils face to the rear.

The size of the particle used should be approximately the same as the thickness desired for the multi-phase structure. For example, if the film of 1.5 mm is desired, the particle should also be about 1.5 mm or less. It is not necessary that the polyethylenes constituting the two phases be mixed in pellet or granule form since particles forming the particle phase can, in effect, be laminated or embedded into the structure between two films of polyethylene. Although this structure can be formed by various methods, such as heat and pressure, it has been found that belt extrusion is ideal.

The selection of the particular polyethylenes for the film and particle phase to obtain the multi-phase structure, according to this invention, can be determined by reference to the known properties of the various polyethylenes available on the market. It is only necessary that the particular phase polyethylene particles or pellets have a sufficiently higher hardness or sufficiently higher melt index so that the particles remain as such during the processing by belt extrusion, for example, to produce the ski sole. As can be noted from Example 1, when the very high density polyethylene HYFAX 1900 granules are mixed with low density polyethylene pellets and extruded, the low density polyethylene forms a film in which the high density polyethylene granules remain in tack during the extrusion process.

The terms "high density", "low density", "medium density", etc. are well defined terms in the art. See for example, THE ENCYCLOPEDIA OF CHEMICAL TECHNOLOGY, Kirk-Othmer, Vol. 16, 3rd Ed. (1981) pp. 385–452. The melt indices and the hardness of these various types of polyethylene polymers are also given in the above text, and it would be a simple matter to select the particular polyethylenes to produce the ski sole of this invention by simple reference to public literature, such as the section referred to in the above encyclopedia.

Low density polyethylene can be irradiated with 1, 2 or 3 megarods of cobalt 60 to increase its hardness and melt index sufficiently so that it can be used as the harder particle phase with the same low density polyethylene. Cross linked, low density polyethylene can also be used for the particle phase. For example, a rod of low density polyethylene can be treated with a silicone oil, exposed to 3 megarods of cobalt 60 and sliced into pellets. The size of the rod should be substantially the same as that desired for the thickness of the sole, for example, about 1.5 mm.

The treatment of the particle phase polyethylene with an incompatible hydrophobic material, such as silicone oil, is important in obtaining the final microfibril structure by abrasion. The surfaces, or part of the surfaces of the particles so treated, thus become incompatible with respect to the softer film phase. This prevents strong bonding of the particles to the film phase and permits extrusion of the mixture while maintaining the two distinct phases. Silicone oil, although preferred, is not essential, as any other incompatible hydrophobic material that will perform the above function can be used.

The ski soles can be used directly and the fibrils will be produced simply by use. The friction and normal abrasive wear will produce the microfibrils. As a practical matter, it is best to do the abrasion in the factory. Any abrasion means can be used.

The abrader cuts the surface into tiny grooves in the sliding direction, but because of the discontinuities in the material, the fibers thus produced are short and oriented backwards. The initial surface thus produced is a mass of close packed fibers which provide an effective sliding base-hydrophobic-and which under-static friction exerts a strong adhesion to the snow.

But, as effective as the surface abrader is, the effect is quite different from that of natural snow-friction. Applicant has found a way to simulate the wear characteristics of snow on the sole material. Ordinarily, stone grinding is employed to trim the polyethylene sole to dimensions as a final preparation of the ski. The cutting liquid is water, and the effect is to remove material leaving behind a shiny smooth surface. By adding to the cutting liquid (water) a silicone oil dispersion, the surface material is still readily removed, but a microstructure is developed which accurately resembles that which results from natural sliding friction on snow. In the case of the unirradiated material, the filament structure develops more or less evenly over the surface, while in the case of the irradiated sole, the original structure is retained and the microfilament structure develops at the interfaces between the irradiated grains. This is the structure that develops in use, and is most desirable from the optimum "slip-stick" ski sole.

EXAMPLE 1

Granulated ultra high molecular weight polyethylene (HIFAX 1900 marketed by Hercules) was treated in a liquid solid V blender with 0.25% dimethyl silicone oil (Dow Corning 200, 60,000 cps). This hard treated polyethylene was blended with low density high melt index polyethylene pellets (Union Carbide DYNN) using 20% by weight of ultra high molecular weight polyethylene, and then extruded into a 1 millimeter thick film to maintain the integrity of the ultra high molecular weight polyethylene granules. A cooled calender roll was used to control thickness. The film so formed was flame treated in the conventional manner to aid in the adhesion of the film to the ski proper. The film was then bonded to a pair of cross-country skis. Light abrasion with a fairly coarse sandpaper caused a uniform development of polyethylene microfibrils all over the running surface. The skis climbed and glided on all kinds of snow in a way comparable with well waxed skis. The glide was equivalent to normal polyethylene based alpine skis. The static friction was very high.

In the above example, 20% by weight represents the optimum amount of the particle phase. At about 5%, the fibrils wear away and at about 30% the glide begins to diminish. The percent of the particle phase is, of course, directly related to the number of fibrils obtained by abrasion.

EXAMPLE 2

Low density polyethylene was extruded into a rod about 0.060 inches in diameter. It was then wiped with a cloth containing silicone oil (GE viscosil 10,000) and given a dose of 3 MR electron beam radiation. This rod was then chopped into pellet form.

These pellets were then distributed in a dense single layer film between 2 films of low density polyethylene, the thickness of which was just sufficient to fill the voids between the compressed pellets (a glue, if you will). Then the total composite was passed, under pressure, through a belt laminator at about 200° C. and subsequently cooled while still under pressure. The resultant film was abraded down to 0.040 inches, flame treated on one side, and laminated to the skis'undersurface.

These skis were then tested for 3 days under conditions varying from thoroughly wet old snow and new snow to damp new snow and finally dry, blown new snow. The performance was monitored by comparing with a pair of skis waxed for the conditions. Over this whole range of conditions there was no case where the waxed ski performed better. The test ski climbed more securely on all conditions, and often glided better. Most noticeably was the easy glide in the normal stride, something which is difficult to measure, but which is very noticeable to the skier.

Inspection of the skis showed that a well defined filament structure developed at the grain boundaries within 2 km of skiing. This surface characteristic was retained undiminished during 3 days of skiing on often quite abrasive conditions.

Other materials can be used to form the multi-phase structures according to this invention, so long as they are hydrophobic polypropylene, polyamides, etc., are examples. Mixtures of different polymers, such as the use of polyamides as the particle phase, and polyethylene as the film phase, can also be used. The use of polyethylene in both phases for ski soles is quite superior, however, due to the high hydrophobicity of polyethylene.

I claim:

1. A composite polyethylene ski sole comprising polyethylene film, polyethylene particles having a higher hardness than the polyethylene film, and a plurality of polyethylene fibers extending from the working surface of the composite polyethylene ski sole at the interface of the particles and film, said fibers being regenerated when the surface of the ski sole is abraded on snow.

2. A ski sole comprising a composite polyethylene film having embedded therein a plurality of polyethylene particles having a higher hardness than the polyethylene film, and having surface characteristics to reduce the adhesion between the particles and the film base which would normally be obtained, said hardness of said particles being sufficiently high and the adhesion being sufficiently reduced such that when the surface of the composite is abraded under skiing conditions, a plurality of fibrils extending from the surface of the composite film are developed at the interface of the particles and the film.

3. A ski sole comprising a multi-phase composite structure comprising a polyethylene film base having embedded therein a plurality of non-film forming polyethylene particles having a higher hardness than the polyethylene film base, the difference in hardness between the particles and the film being sufficient to create frictional discontinuities and the adhesion between the film and the particles being sufficiently reduced so that abrasion of the multi-phase structure under skiing conditions causes the formation of a plurality of fibers at the interface of the particles and film which fibers extend from the surface of the multi-phase structure.

4. A method for making a multi-phase polyethylene structure comprising film-forming polyethylene and polyethylene particles having a higher hardness than the film-forming polyethylene and which polyethylene particles will not form a film under film-forming conditions which comprises:

(1) treating at least part of the surface of the polyethylene particles with a material which is incompatible with polyethylene or which will reduce the adhesion of the particles to the film-forming polyethylene, (2) mixing the treated polyethylene particles with the film forming polyethylene, and (3) forming a film of the mixture so that the treated polyethylene particles remain substantially intact to produce a multi-phase structure having polyethylene particles embeded in a film of polyethylene.

5. The method of claim 4 wherein said particles have a sufficiently higher hardness than the film forming polyethylene film and a sufficiently reduced adhesion to the polyethylene film so that a plurality of fibers are formed at the particle-film interfaces extending from the surface of the film when the surface of the multi-phase structure is abraded.

6. The method of claim 4 wherein the treated particles are high density polyethylene and the film forming polyethylene is low density polyethylene.

7. The method of claim 4 wherein the material is used to treat the polyethylene particles is hydrophobic.

8. The method of claim 7 wherein the hydrophobic material is a silicone oil.

9. A method for making a multi-phase polyethylene composite comprising a film-forming polyethylene and polyethylene particles having a higher hardness than the film-forming polyethylene and which polyethylene particles will not form a film under the film-forming conditions which comprises:

(1) treating at least part of the surface of polyethylene particles with a material which is incompatible with polyethylene or which will reduce the adhesion of the particles to the film-forming polyethylene, (2) mixing the polyethylene particles with the film forming polyethylene, and (3) forming a film of the mixture so that the treated polyethylene particles remain substantially intact to produce a multi-phase structure having polyethylene particles embedded in a film of polyethylene, said film forming polyethylene having sufficiently reduced adhesion to the embedded polyethylene particles of higher hardness so that a plurality of fibers are formed extending from the interfaces of the particles and film of the multi-phase structure when the surface of the structure is abraded on snow.

10. The method according to claim 9 wherein the treated particles are ultra high molecular weight or slightly crosslinked polyethylene and the film forming polyethylene is low or medium density polyethylene.

11. The method according to claim 10 in which the material used to treat the polyethylene particles is hydrophobic.

12. The method according to claim 11 in which the hydrophobic material is a silicone oil.

* * * * *